United States Patent [19]

Tokunaga et al.

[11] 4,284,440

[45] Aug. 18, 1981

[54] RARE EARTH METAL-COBALT PERMANENT MAGNET ALLOY

[75] Inventors: Masaaki Tokunaga; Chitoshi Hagi; Hirokazu Murayama, all of Kumagaya, Japan

[73] Assignee: Hitachi Metals, Ltd., Tokyo, Japan

[21] Appl. No.: 808,365

[22] Filed: Jun. 20, 1977

[30] Foreign Application Priority Data

Jun. 18, 1976 [JP] Japan ..... 51-71140

[51] Int. Cl.[3] ..... H01F 1/04; H01F 1/14

[52] U.S. Cl. ..... 148/31.57

[58] Field of Search ..... 148/31.57, 101, 103, 148/105; 75/152

[56] References Cited

U.S. PATENT DOCUMENTS

| | | | |
|---|---|---|---|
| 3,617,260 | 11/1971 | Detert | 148/31.55 |
| 3,947,295 | 3/1976 | Tawara et al. | 148/31.57 |
| 3,977,917 | 8/1976 | Fujimura et al. | 148/31.57 |
| 3,982,971 | 9/1976 | Yamanaka et al. | 148/31.57 |
| 4,047,982 | 9/1977 | Sagawa et al. | 148/31.57 |
| 4,081,297 | 3/1978 | Nagel et al. | 75/152 |
| 4,131,495 | 12/1978 | Menth et al. | 148/31.57 |
| 4,135,953 | 1/1979 | Nagel et al. | 148/31.57 |
| 4,210,471 | 7/1980 | Yoneyama et al. | 148/102 |
| 4,211,585 | 7/1980 | Inomata et al. | 148/31.57 |
| 4,213,802 | 7/1980 | Rothwarf et al. | 148/31.57 |
| 4,213,803 | 7/1980 | Yoneyama et al. | 75/170 |

FOREIGN PATENT DOCUMENTS 47-38721 9/1972 Japan .

*Primary Examiner*—Michael L. Lewis

*Attorney, Agent, or Firm*—Craig and Antonelli

[57] ABSTRACT

A permanent magnet alloy made by adding one or more of Si, Ti, Zr, V, Nb, Cr, and Mo to a known permanent magnet alloy containing rare earth metals, Co, Fe, and Cu. By adding such additives, the amount of substitution of copper required for full precipitation hardening is reduced in the alloy of the present invention for the improvement in magnetic characteristics and thermal stability.

10 Claims, 3 Drawing Figures

RARE EARTH METAL-COBALT PERMANENT MAGNET ALLOY

BRIEF SUMMARY OF THE INVENTION

The present invention relates to an improvement of an inter-metallic compound comprising mainly rare earth metals and cobalt, and more particularly to a low rare-earth elements Cu-added $R_2Co_{17}$ type permanent magnet alloy. An alloy containing a rare earth metal or metals consisting of one or a combination of two or more rare earth elements, including mainly Sm and/or Ce (hereinafter referred to as R), Co, Fe, and Cu, which may be expressed by a formula $R(Co_{1-x-y}Fe_xCu_y)A$, where $0.01 \leqq x \leqq 0.02$, $0.05 \leqq y \leqq 0.25$, and $6.5 \leqq A \leqq 8.0$, is known as a permanent magnet material having excellent residual magnetic flux density (Br) and coercive force (BHc, IHc), e.g. Japanese Laid-Open Patent Publication No. 1397/75. In the permanent magnet made of said alloy, an energy product ((BH)max) amounting to 25MGOe is obtained and various applications to make best use of the property have been already made. However, in the magnets of this type, the amount of Cu for substituting Co necessary for precipitation hardening has been large, which resulting in a decrease in Br., thus Br of 10500G has been the maximum that could be obtained. The decrease in Curie point due to the copper substitution has also brought about a decrease in thermal stability. On the other hand, as the replacement of Co by Fe, which is effective for increasing Br, lowers the coercive force if replaced Fe is excessive, thus the desirable amount x of the Fe replacement has been 0.1 at the most. Further, the value A required for obtaining a sufficient coercive force and a better rectangularity in hysteresis curve has been 7.0–7.5 so that a high Br has not been obtainable.

An object of the present invention is to provide a permanent magnet alloy with which a high energy product can be obtained.

Another object of the present invention is to provide a permanent magnet alloy capable of retaining a high residual magnetic flux density.

A further object of the present invention is to provide a permanent magnet alloy capable of having a high coercive force.

The present invention is characterized by adding one or a combination of two or more of Si, Ti, Zr, V, Nb, Cr, and Mo (hereafter referred to as M) to the conventional $R_2Co_{17}$ type permanent magnet alloy described above, the amount of Cu substitution required for full precipitation hardening is reduced and thereby a permanent magnet alloy having better magnetic characteristics is obtained.

DETAILED DESCRIPTION

Figure 1:
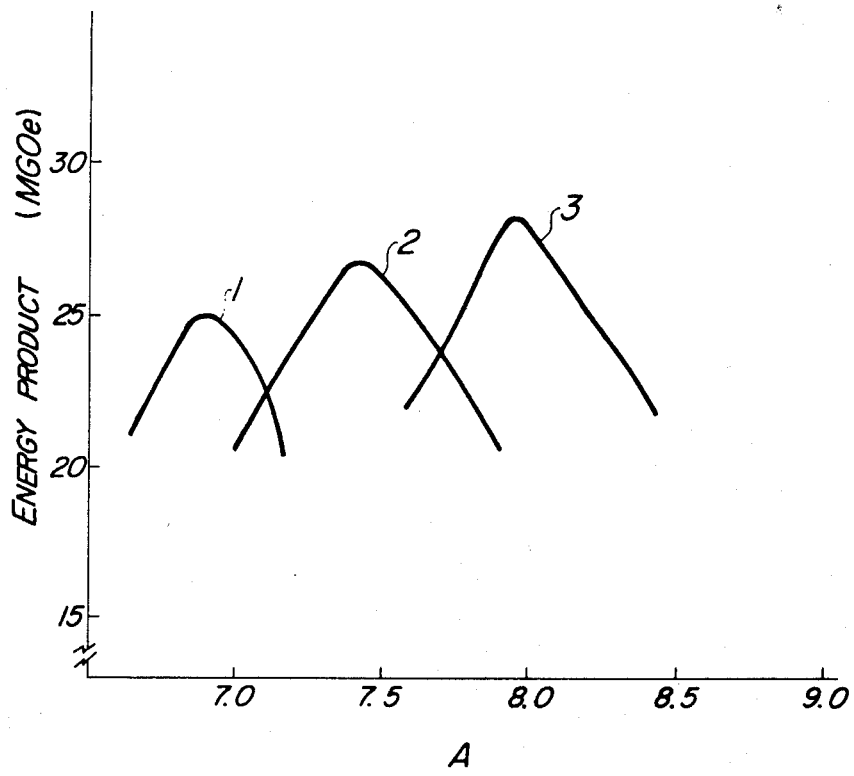
FIG. 1 is a graph showing the relationship between the energy product ((BH)max) and value A for various amounts of Si addition obtained in Example 3.

The inventors found as a result of various tests that the amount of Cu for substituting Co necessary for precipitation hardening to obtain a sufficient IHc could be reduced by adding either one of or combination of Si, Ti, Zr, V, Nb, Cr, and/or Mo. The addition of said elements generally lower the Br and Curie point as does the addition of Cu. According to the present invention, however, both Br and Curie point are raised because the amount of Cu replacement can be reduced. Consequently, the addition of said elements has the advantage that it can improve Cu-added $R_2Co_{17}$ type magnets in both magnetic characteristics and thermal stability.

When the amount of addition of Si, Ti, Zr, V, Nb, Cr, and/or Mo is less than and not including 0.001, it is difficult to reduce the amount of Cu replacement. On the other hand, the addition of these elements in excess of 0.15 brings about degradation both in magnetic characteristics due to the drop in Br and thermal stability due to drop in Curie point, and makes the alloy unsuitable for a permanent magnet.

In the present invention, the addition of Fe is not necessarily required but by so doing the Br and coercive force can be controlled. Generally the decrease in the amount of additional Fe lowers the Br and an excessive addition of Fe causes the lowering of its coercive force. On the other hand, when the additives in accordance with this invention are added, the increase in the amount of Fe substitution which is effective for increasing Br, does not reduce the coercive force, and therefore, the Fe substitution can be made in larger amounts than in the case where no such additives are contained. When the amount of Cu substitution is less than 0.02, the additives according to the present invention will not obtain a coercive force sufficient for a so-called precipitation hardening type permanent magnet. The amount of Cu substitution more than 0.25 gives rise to the decrease of Br, thus this invention can not be effectively utilized. Further, the addition of Si, Ti, Zr, V, Nb, Cr, and/or Mo can raise A value suitable for obtaining a sufficient coercive force. That is, while A value of 7–7.5 is preferable for the alloys in which said additives are not included, it can be raised to 7.5–8.3 by the addition of said elements. It is apparent that the addition of the above-mentioned elements is effective also in this regard.

Now the present invention will be further explained with reference to the following embodiments.

EXAMPLE 1

An alloy Sm $(Co_{0.81}Fe_{0.1}Cu_{0.08}Si_{0.01})_{7.0}$ was prepared by electric arc melting and after rough crushing in an iron mortar, pulverized with toluene in a vibration mill into fine powder. This finely crushed powder was compression formed in a magnetic field of 8 KOe using a metal mold under a pressure of 5 ton/cm$^2$. The compressed powder were then sintered at 1200° C. for one hour in Ar atmosphere. The magnetic characteristics of the sintered product obtained were Br=9500G, BHc=4000 Oe, IHc=4200 Oe and (BH)max=20MGOe. Further it was aged at 800° C. for 2 hours. The magnetic characteristics of thus obtained aged product were Br=9500G, BHc=5200 Oe, IHc=5500 Oe and (BH)max=22MGOe.

EXAMPLE 2

An alloy Sm $(Co_{0.81}\ Fe_{0.12}\ Cu_{0.05}\ Cr_{0.02})_{7.5}$ was prepared by electric arc melting and crushed in the same way as in the Example 1. The pulverized powder were then oriented in a magnetic field of 15 KOe and then compression-molded under the pressure of 3 ton/cm$^2$ using a static hydraulic press. The molding thus obtained was sintered in a vacuum at a temperature of 1200° C. for one hour. The magnetic characteristics obtained were Br=10800G, BHc=5000 Oe, IHc=5200 Oe and (BH)max=27.3 MGOe.

EXAMPLE 3

Alloys represented by Sm $(Co_{0.75}\ Fe_{0.10}\ Cu_{0.15})_A$, Sm $(Co_{0.79}\ Fe_{0.12}\ Cu_{0.08}\ Si_{0.01})_A$, and Sm $(Co_{0.80}\ Fe_{0.15}\ Cu_{0.03}\ Si_{0.02})_A$ and further designated with various values of A are melted, and each sample was mode in the same manner as in the Example 2. FIG. 1 is a graph showing the relationships between (BH)max and value of A for said three types of samples. In FIG. 1, curve 1 is for Sm $(Co_{0.75}\ Fe_{0.10}\ Cu_{0.15})_A$, curve 2 is for Sm $(Co_{0.79}\ Fe_{0.12}\ Cu_{0.08}\ Si_{0.01})_A$ and curve 3 is for Sm $(Co_{0.80}\ Fe_{0.15}\ Cu_{0.03}\ Si_{0.02})_A$. As apparent from the graph, it can be noted that the required amount of Cu substitution decreases as the amount of Si to be added increases and high (BH)max is obtained at a higher A value.

EXAMPLE 4

An alloy consisting of $Sm_{0.09}\ Y_{0.1}\ (Co_{0.73}\ Fe_{0.15}\ Cu_{0.11}\ Nb_{0.01})_{7.2}$ was prepared by high frequency melting. The alloy thus prepared was crushed by a jaw crusher and ground with a grinding mill into powders which was then made into fine powders with a jet mill using $N_2$ gas a pulverizing agent. The powders were then magnetically oriented in a magnetic field of 15 KOe and compression-formed with a static hydraulic press under the pressure of 3 tons/cm$^2$. The molding thus formed was vacuum sintered for one hour at 1180° C. After sintering, it was solution treated at 1180° C. for 30 minutes and than quenched in water. It was further subjected to an aging at 800° C. for two hours.

The magnetic characteristics of the product thus obtained were as follows:

Br: 10600 G
BHc: 6200 Oe
IHc: 6500 Oe
(BH)max: 27.5 MGOe

EXAMPLE 5

An alloy consisting of Sm $(Co_{0.708}\ Fe_{0.2}\ Cu0.08\ Zr_{0.012})_{7.6}$ was made into fine powders and formed in the same way as described in the Example 4. The formed product was then vacuum sintered at 1190° C. for two hours. After sintering, it was solution treated at 1170° C. for one hour and quenched in Ar gas atmosphere.

The magnetic characteristics of the product were as follows.

Br: 11200 G
BHc: 1000 Oe
IHc: 1000 Oe

Further it was aged at 800° C. for one hour and then gradually cooled at a cooling rate of 1° C./min. The magnetic characteristic obtained were as shown below:

Br: 11200 G
BHc: 5500 Oe
IHc: 5800 Oe
(BH)max: 29.5 MGOe

EXAMPLE 6

An alloy consisting of Sm $(Co_{0.662}\ Fe_{0.22}\ Cu_{0.11}\ Ti_{0.008})_{7.5}$ was melted, pulverized, sintered and heat-treated in the same way as in the Example 5. Magnetic characteristics of the product were as follows:

Br: 11300 G
BHc: 5000 Oe
IHc: 5400 Oe
(BH)max: 28.5 MGOe

EXAMPLE 7

An alloy consisting of Sm $(Co_{0.727}\ Fe_{0.17}\ Cu_{0.09}\ V_{0.005}\ Nb_{0.008})_{7.2}$ was made into powders and formed in the same way as described in Example 4 to obtain a formed product which was then vacuum sintered at 1180° C. for two hours and quenched by blasting Ar gas. The product exhibited the following magnetic characteristics:

Br: 10780 G
BHc: 950 Oe
IHc: 1050 Oe

The same product was further put to a multi-stage aging starting from 800° C. and cooling down the aging temperature by 100° C. each time until 400° C. At each temperature stage, it was retained for two hours. The magnetic characteristics obtained thereof were as follows:

Br: 10780 G
BHc: 5800 Oe
IHc: 6200 Oe
(BH)max: 29.0 MGOe

EXAMPLE 8

Figure 2:
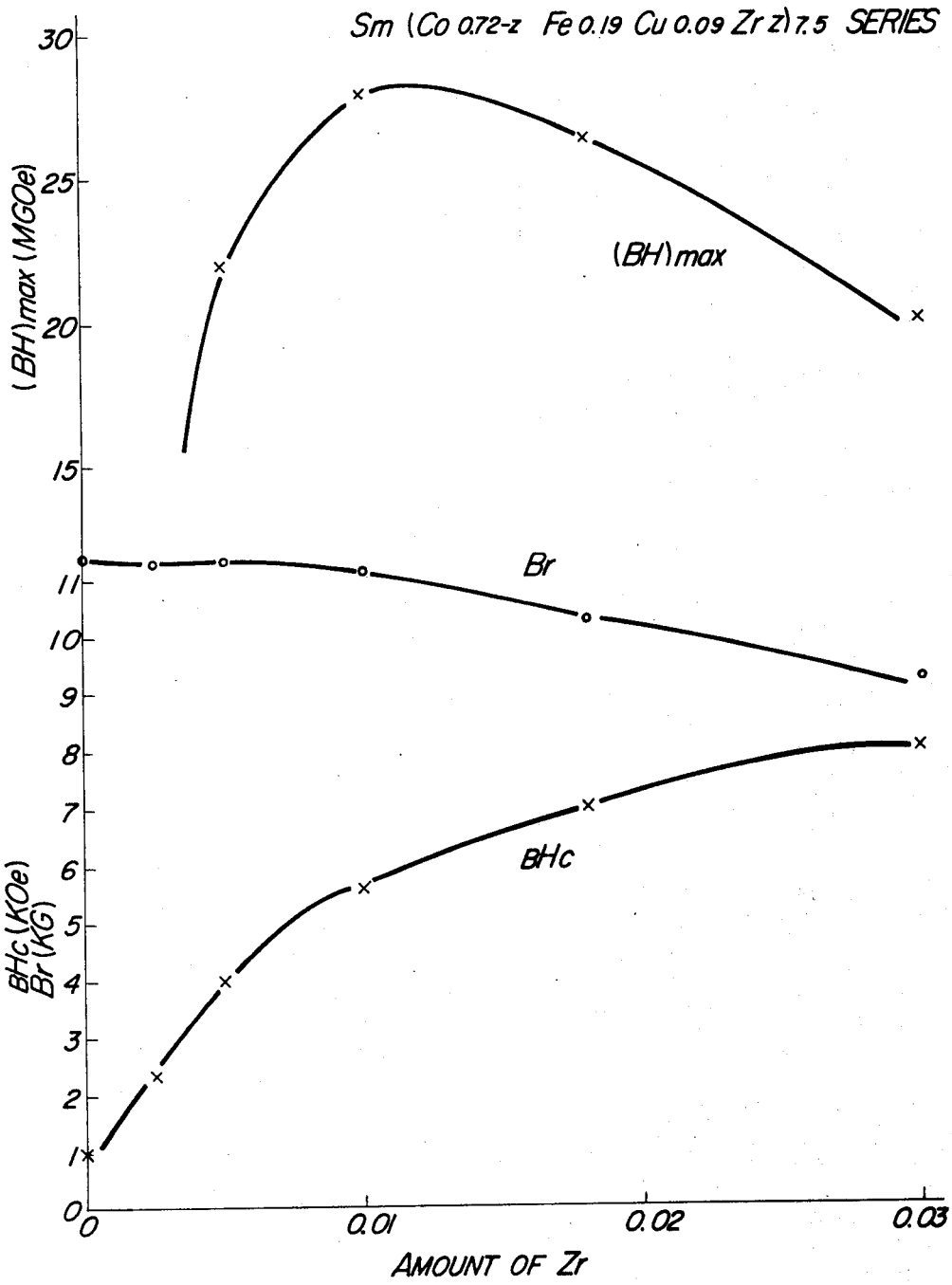
FIG. 2 is a graph showing the relationship between amount of Zr and values of (BH)max, Br and BHc obtained by alloys of Sm $(Co_{0.72-z}Fe_{0.19}Cu_{0.09}Zr_z)_{7.5}$ series.

Alloys consisting of Sm $(Co_{0.72-z}\ Fe_{0.19}\ Cu_{0.09}\ Zr_z)_{7.5}$ (z: 0, 0.025, 0.005, 0.01, 0.02, 0.03) were finely pulverized and formed under pressure. The products thus obtained were vacuum sintered at 1190° C. for two hours. After sintering, they were solution treated, quenched in water and then aged at 800° C. After having been retained at 800° C. for one hour, they were gradually cooled at a cooling rate of 0.7° C./min until 400° C. FIG. 2 shows the relation of value z with Br, IHc, and (BH)max. As z increases, Br goes down while IHc goes up, and (BH)max reaches to the maximum point when Zr is near z=0.01. This indicates that the addition of Zr is effective for increasing IHc, though there accompanies a decrease of Br.

EXAMPLE 9

Figure 3:
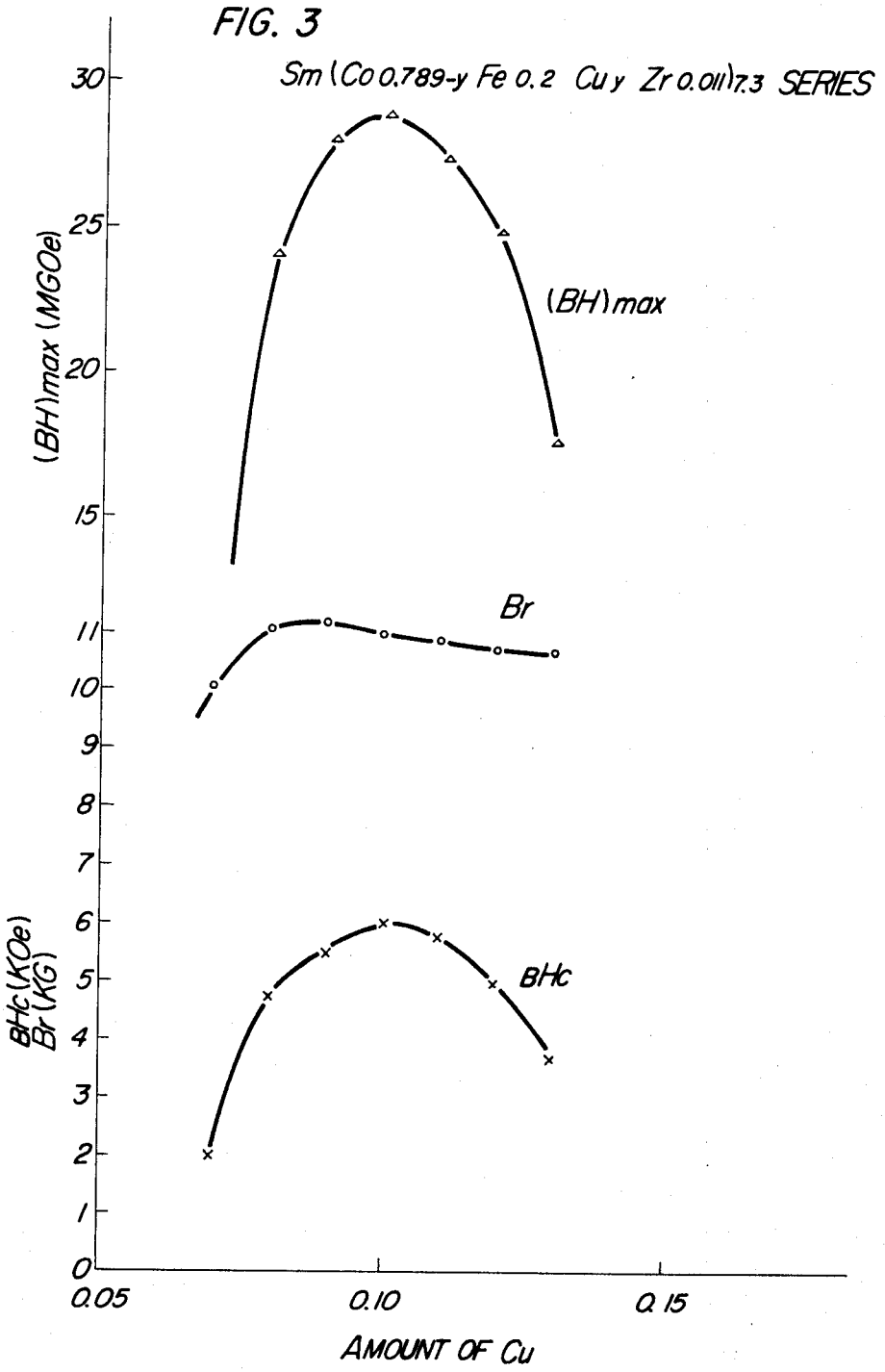
FIG. 3 is a graph showing the relation between the amount of Cu and (BH)max, Br and BHc obtained by alloys of Sm $(Co_{0.789-y}Fe_{0.2}Cu_yZr_{0.011})_{7.3}$ series.

Alloys consisting of Sm $(Co_{0.789-y}\ Fe_{0.2}\ Cu_y\ Zr_{0.011})_{7.3}$ (y: 0.07, 0.08, 0.09, 0.10, 0.11, 0.12, 0.13) were ground, sintered, and heat-treated in the same way as described in the preceding Example 8. FIG. 3 shows the effect of value y on Br, IHc and (BH)max. While Br increases as y decreases. IHc shows the maximum value when y=0.1 and (BH)max becomes greatest at about y=0.09~0.1.

EXAMPLE 10

Table 1 shows the magnetic characteristics of the alloys containing a plurality of additives. The products were prepared in the same way as in Example 4.

TABLE 1

| Type of alloy | Magnetic property | | |
|---|---|---|---|
| | Br (G) | βHc (Oe) | (BH)max MGOe |
| $Sm(Co_{0.748}Fe_{0.12}Cu_{0.12}Cr_{0.005}Ti_{0.007})_{7.3}$ | 10600 | 5500 | 27.0 |
| $Sm(Co_{0.748}Fe_{0.12}Cu_{0.12}Mo_{0.005}Zr_{0.007})_{7.3}$ | 10500 | 5800 | 27.1 |
| $Sm(Co_{0.748}Fe_{0.12}Cu_{0.12}Si_{0.003}Zr_{0.009})_{7.3}$ | 10500 | 6000 | 27.3 |

We claim:

1. A permanent magnet alloy consisting essentially of a composition expressed by a formula:

$$R(Co_{1-x-y-z}Fe_xCu_yM_z)_A$$

wherein

R is one of the rare earth metal elements, M is at least Si or combination of Si with Ti and Mo, and $0.1 \leqq x \leqq 0.4$, $0.02 \leqq y \leqq 0.25$, $0.001 \leqq z \leqq 0.15$ and $6.5 \leqq A \leqq 8.3$.

2. A permanent magnet alloy as set forth in claim 1, wherein R is Sm and $x=0.1$, $y=0.08$, $z=0.01$, $A=7.0$.

3. A permanent magnet alloy as set forth in claim 1, wherein R is Sm and $x=0.12$, $y=0.05$, $z=0.02$, $A=7.5$.

4. A permanent magnet alloy as set forth in claim 1, wherein $7.5 \leqq A \leqq 8.3$.

5. A permanent magnet alloy as set forth in claim 1, wherein R is Sm, Y or a combination thereof.

6. A permanent magnet alloy as set forth in claim 1, wherein $0.02 \leqq y \leqq 0.13$.

7. A permanent magnetic alloy as set forth in claim 1, wherein R is Sm and $0.001 \leqq z \leqq 0.05$.

8. A permanent magnetic alloy consisting essentially of a composition expressed by a formula:

$$R(Co_{1-x-y-z}Fe_xCu_ySi_z)_A$$

wherein R is at least one of the rare earth metal elements, $0.1 \leqq x \leqq 0.4$, $0.02 \leqq y \leqq 0.25$, $0.001 \leqq z \leqq 0.15$ and $6.5 \leqq A \leqq 8.3$.

9. A permanent magnetic alloy as set forth in claim 8, wherein $0.02 \leqq y \leqq 0.13$.

10. A permanent magnetic alloy consisting essentially of a composition expressed by a formula:

$$R(Co_{1-x-y-z}Fe_xCu_ySi_z)_A$$

wherein R is Sm, $0.1 \leqq x \leqq 0.4$, $0.02 \leqq y \leqq 0.25$, $0.001 \leqq z \leqq 0.15$ and $6.5 \leqq A \leqq 8.3$.

* * * * *